US005358254A

United States Patent [19]

Yeh

[11] Patent Number: 5,358,254

[45] Date of Patent: Oct. 25, 1994

[54] TOY GUN AND TARGET SET

[76] Inventor: Hsiu-Ying Yeh, 2F. No. 4-1, Alley 7, Lane 135, Chu Kwang Road, Pao-Chiao Taipei, Taiwan

[21] Appl. No.: 142,039

[22] Filed: Oct. 28, 1993

[51] Int. Cl.[5] ..... A63F 9/02; F41J 9/00

[52] U.S. Cl. ..... 273/366; 273/397; 273/410

[58] Field of Search ..... 273/368, 366, 397, 394, 273/348, 359, 367, 396, 410, 355, 356; 446/332, 236

[56] References Cited

U.S. PATENT DOCUMENTS

| | | | |
|---|---|---|---|
| 1,540,802 | 6/1925 | Ordway | 273/368 |
| 1,641,977 | 9/1927 | Littlefield | 273/368 X |
| 1,650,935 | 11/1927 | Cox | 273/368 |
| 1,788,889 | 1/1931 | Ritchie | 273/366 |
| 2,510,380 | 6/1950 | Clifford | 273/366 |
| 4,824,120 | 4/1989 | Wang | 273/394 X |

*Primary Examiner*—Mickey Yu
*Attorney, Agent, or Firm*—Lowe, Price, LeBlanc & Becker

[57] ABSTRACT

A toy gun and target set includes a carrying case having a curtain and a folding back board on the case cover thereof and a bottom chamber to carry toy guns, two target conveyers inside the carrying case and driven by a sliding rack through a clockwork & gear set to move a mobile target, and a game over sign carried on a linking mechanism and moved from a vertical position to a horizontal position as the sliding rack is pulled out of the carrying case to start the clockwork & gear set, the mobile target having pins aligned on two opposite sides of the target body thereof and respectively inserted through pin holes on two opposite face boards thereof, the face boards being respectively hinged to the target body and turned outwards from the target body to remove toy bullets being retained in spaces between the pins.

1 Claim, 6 Drawing Sheets

TOY GUN AND TARGET SET

BACKGROUND OF THE INVENTION

The present invention relates to a toy gun and target set which is comprised of two target conveyers driven by a sliding rack through a clockwork & gear set to move a mobile target, and which is received within a carrying case when not in play.

Various toy guns with targets have been disclosed for children to play the game of shooting, and have appeared on the market. Because the targets must be fixed in place during the game, children will find monotonous and less interesting after few times in play. Furthermore, the toy bullets may go off in different directions, and the players must have to find and collect the missed toy bullets after the game.

SUMMARY OF THE INVENTION

The present invention eliminates the aforesaid drawbacks. It is therefore an object of the present invention to provide a toy gun and target set which can be carried in a carrying case when not in play. It is another object of the present invention to provide a toy gun and target set which does not consume electric power supply. It is another object of the present invention to provide a toy gun and target set which can be convenient set into the operative mode. It is still another object of the present invention to provide a toy gun and target set which provides a mobile target for shooting. It is still another object of the present invention to provide a toy gun and target set which can automatically collect the toy bullets for repeated uses. It is still another object of the present invention to provide a toy gun and target set which can be alternatively arranged to move the mobile target thereof between two different speeds.

To achieve these objects, there is provided a toy gun and target set comprised of a carrying case having a curtain and a folding back board on the case cover thereof and a bottom chamber to carry toy guns, two target conveyers inside the carrying case and driven by a sliding rack through a clockwork & gear set to alternatively move a mobile target at a different speed, and a game over sign carried on a linking mechanism and moved from a vertical position to a horizontal position as the sliding rack is pulled out of the carrying case to start the clockwork & gear set. The mobile target has pins aligned on two opposite sides of the target body thereof and respectively inserted through pin holes on two opposite face boards thereof. The face boards are respectively hinged to the target body and can be turned outwards from the target body to remove toy bullets being retained in spaces between the pins.

BRIEF DESCRIPTION OF THE DRAWINGS

FIG. 5-1 shows a link moved by a sliding rack to lift a GAME OVER sign according to the present invention;

FIG. 5-2 shows the link moved by the sliding rack to lower the GAME OVER sign.

DETAILED DESCRIPTION OF THE PREFERRED EMBODIMENT

Figure 1:
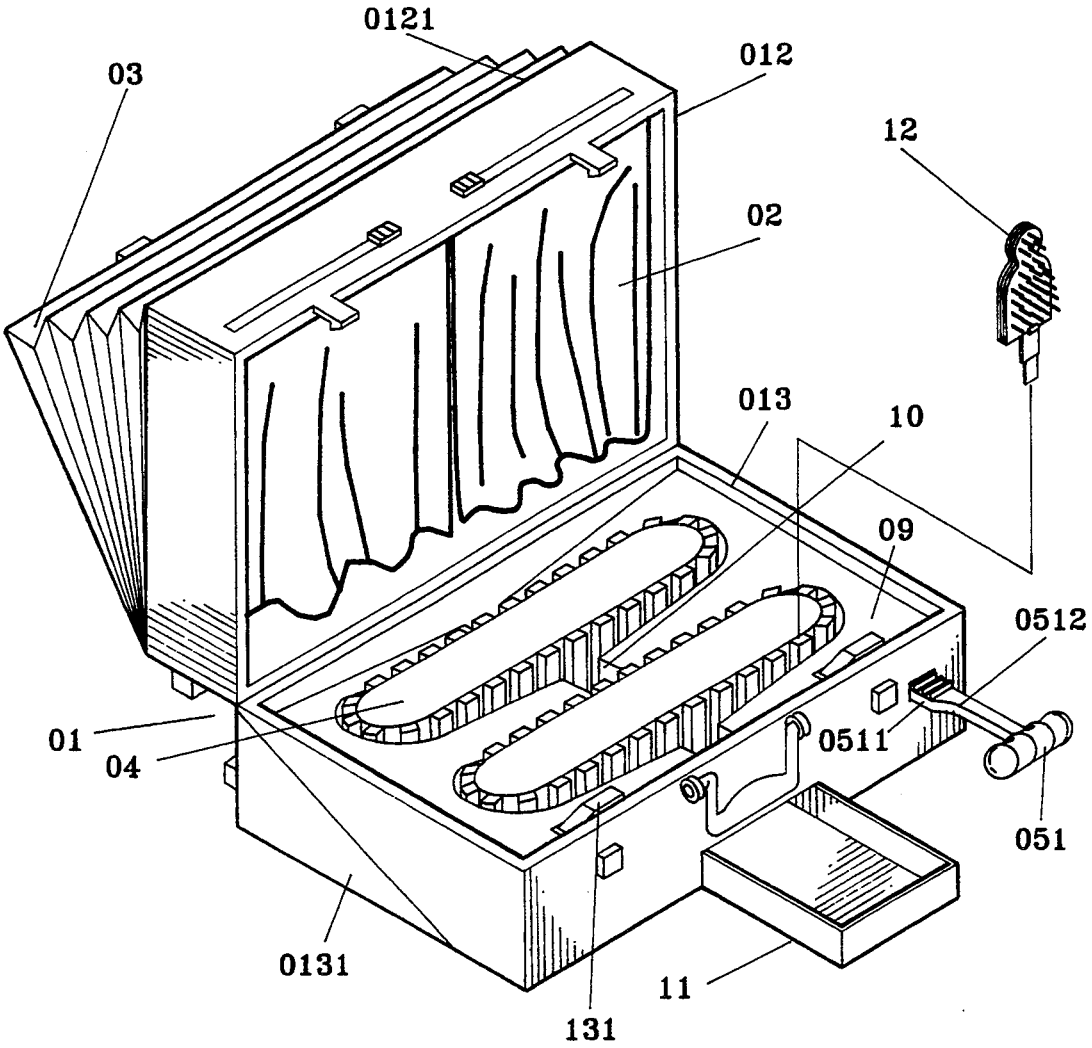
FIG. 1 shows a toy gun and target set according to the preferred embodiment of the present invention when opened.
Figure 2:
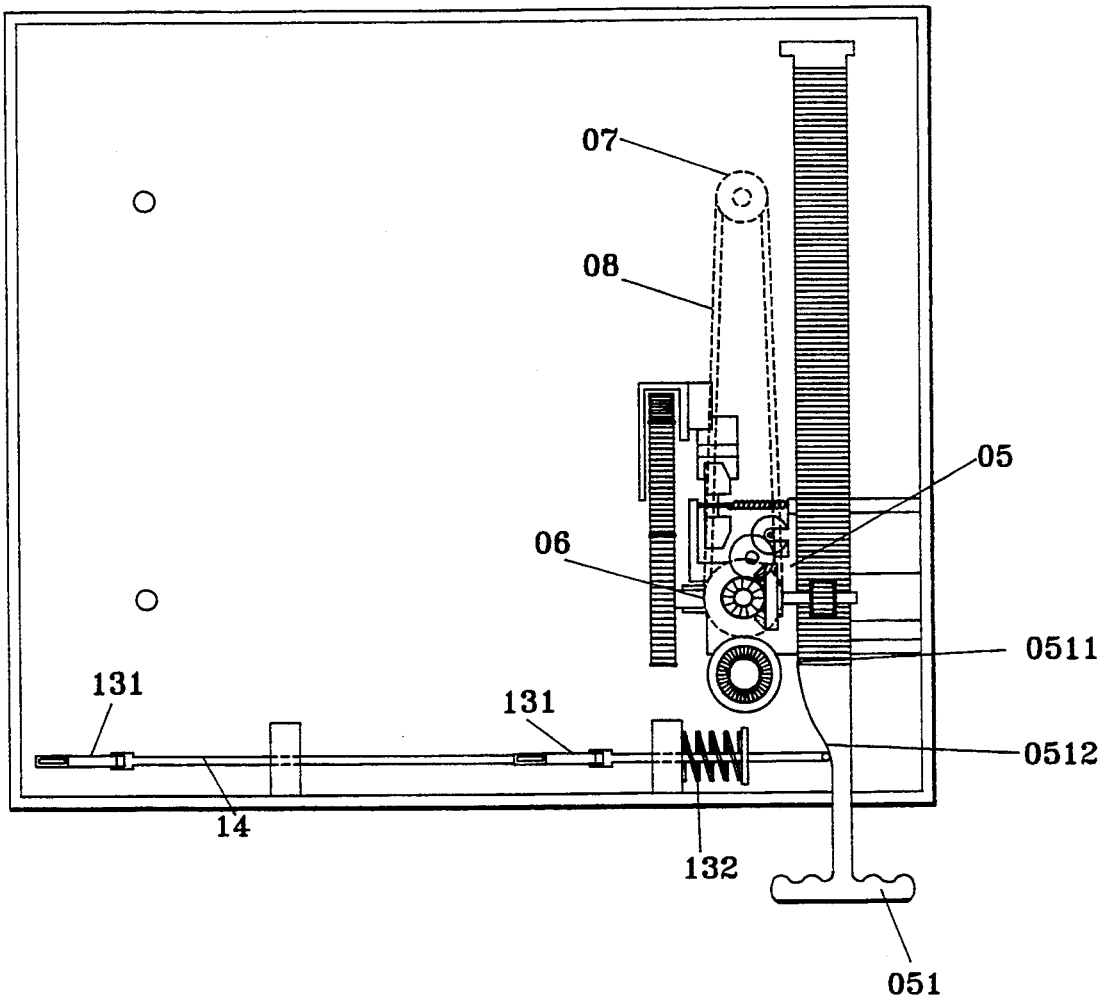
FIG. 2 is a plain view of the case body of the toy gun and target set of FIG. 1, showing the internal driving mechanism thereof.
Figure 3:
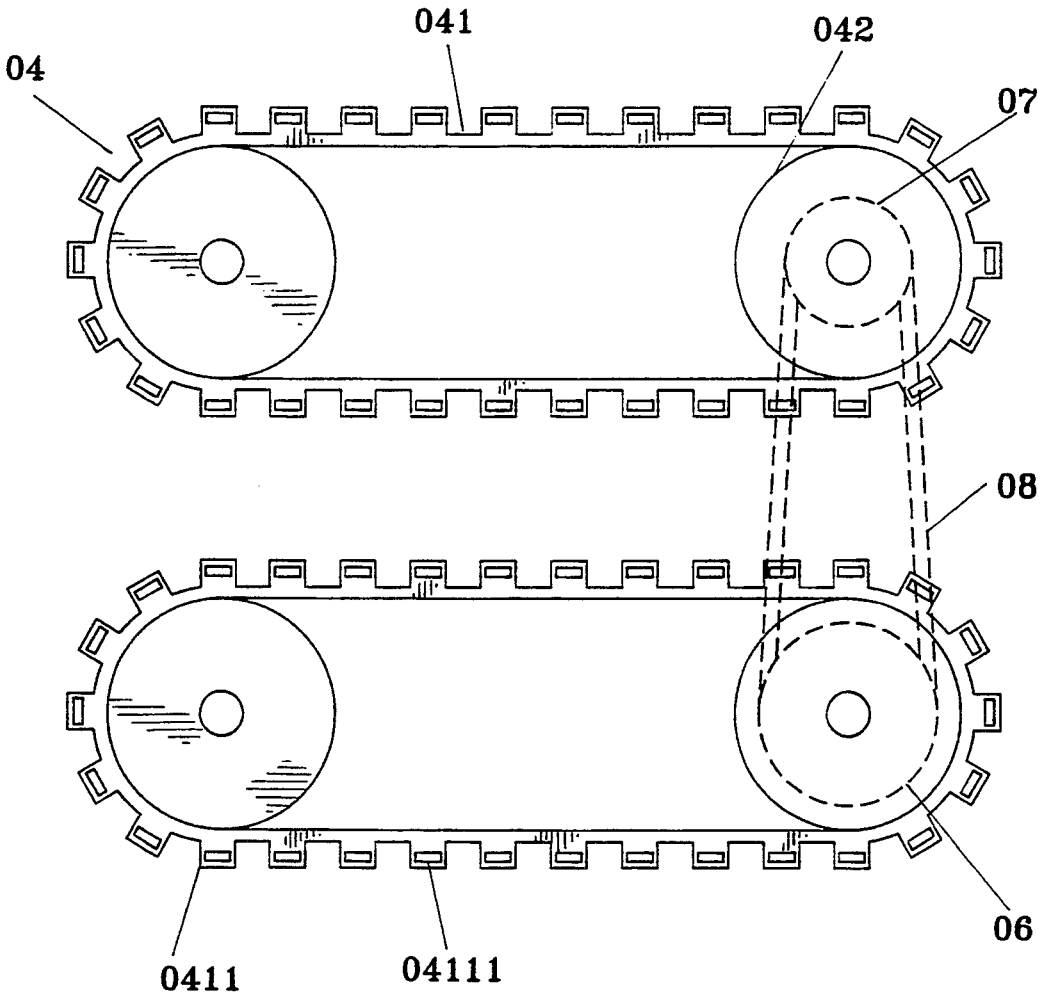
FIG. 3 is a plain view of the target conveyers of the toy gun and target set of FIG. 1.
Figure 4A:
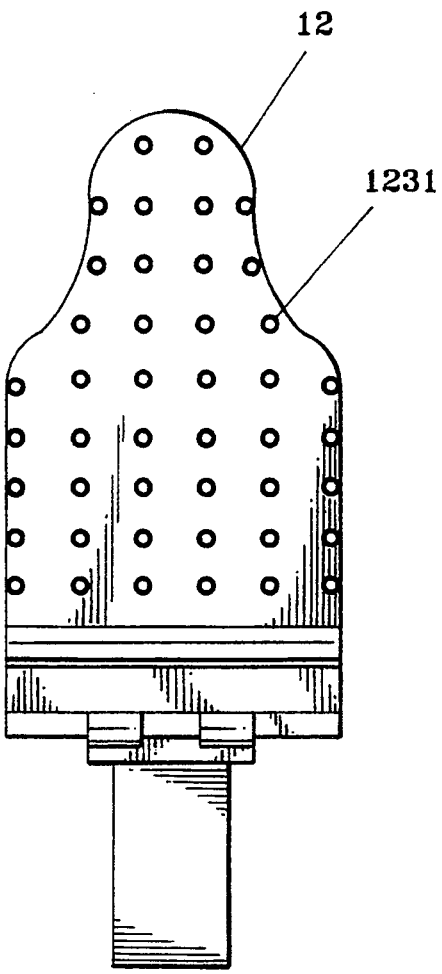
FIG. 4 shows the structure of the mobile target of the toy gun and target set of FIG. 1 and its operation.
Figure 4B:
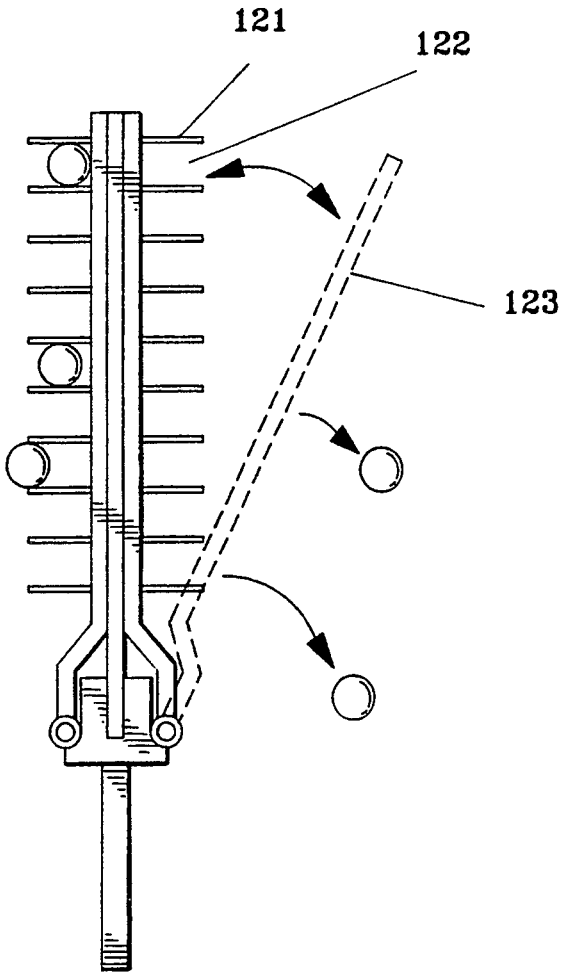

Referring to FIGS. 1, 2, 3, 4, and 6, a toy gun and target set in accordance with the preferred embodiment of the present invention is generally comprised of a case, referenced by 01, for carrying with the hand. The cover 012 of the case 01 is made of a rectangular open frame, having a curtain 02 hung on the inside. A pleated, expansible back board 03 is fastened to the back 0121 of the cover 012. The curtain 02 is to stop the bullets for allowing them to be gathered within the folding back 03 and guided into the case body 013 of the case 01 and then guided by the concave top surface 09 of the case body 013 and a guide slot 10 on the concave inside wall 09 to move into a bullet collecting drawer 11 in the case body 013. There is a clockwork & gear set 05 disposed at one side within the case body 013, and meshed with a sliding rack 051 (see FIG. 2). By pulling out the sliding rack 051, the clockwork of the clockwork & gear set 05 is wound tight. As the clockwork & gear set 05 is actuated to work, a GAME OVER singe 13 is moved down inside the case body 013, and at the same time a belt pulley 06 is rotated to turn a driven wheel 07 through a transmission belt 08. Two target conveyers 04 are mounted within the case body 013 and respectively coupled to the belt pulley 06 and the driven wheel 07. The belt pulley 06 and the driven wheel 07 may be made in different sizes so that the target conveyers 04 can be rotated at different speeds. Each target conveyer 04 is comprised of two wheels 042 and a conveyer belt 041 mounted around the wheels 042 (see FIG. 3). The conveyer belt 041 comprises a series of flanges 0411 around the outside surface, each flange 0411 having a plug hole 04111 for mounting a mobile target 12. The mobile target 12 has pins 121 longitudinally and transversely aligned on two opposite sides thereof respectively inserted through pin holes 1231 on two opposite face boards 123 thereof (see FIG. 4). By turning the face boards 123 outwards from the mobile target 12, bullets being retained in spaces 122 between the pins 121 are removed from the mobile target 12 to fall to the case body 013 and then to be guided into the bullet collecting drawer 11. The case body 013 has a bottom chamber 0131 that can be opened for carrying toy guns 15 (see FIG. 6).

Figure 5A:
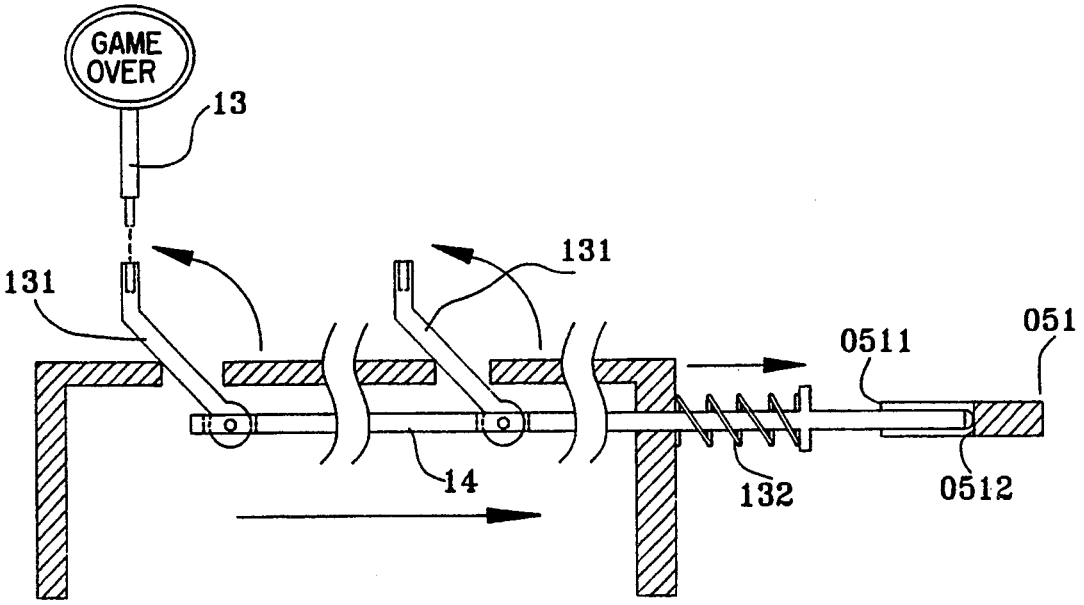
Figure 5B:
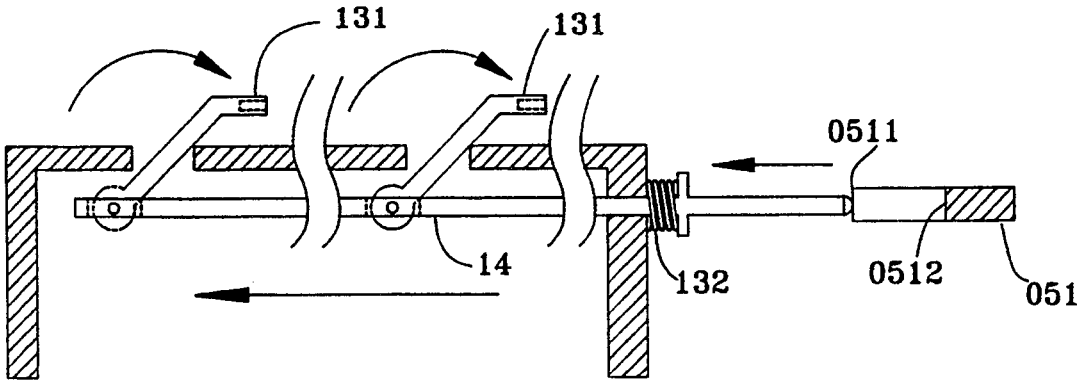
Figure 6:
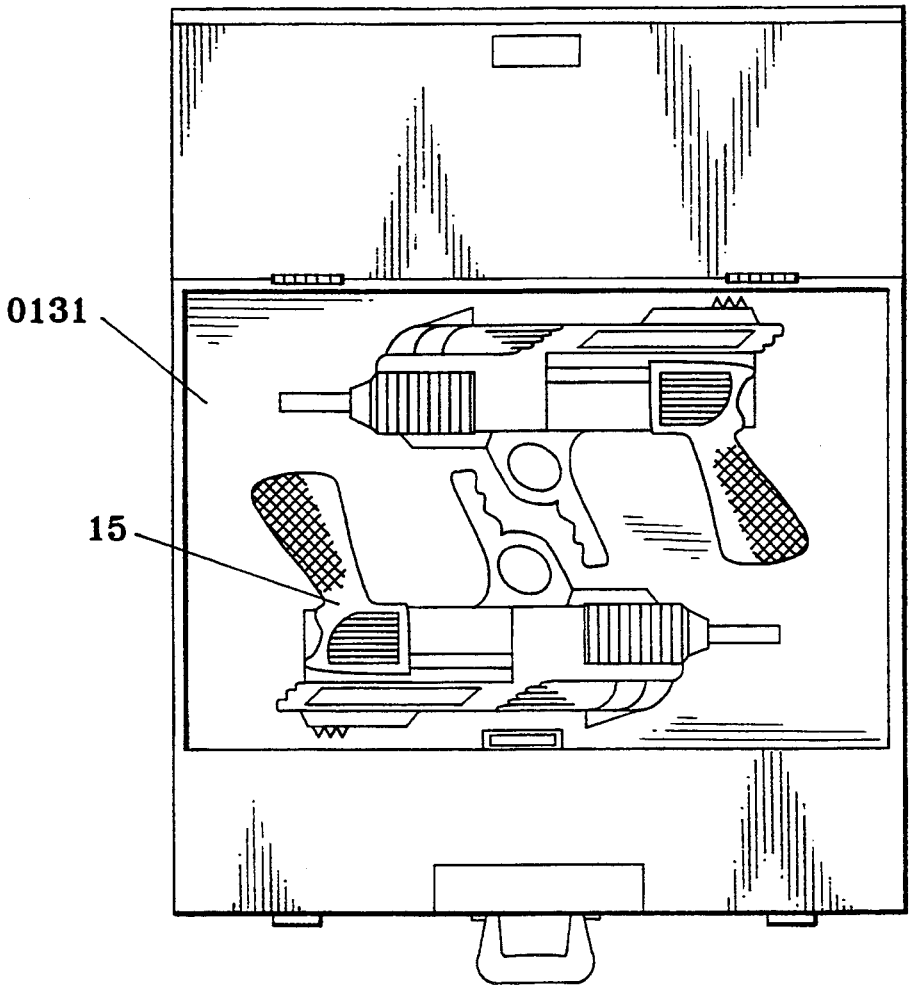
FIG. 6 is a plain view of the bottom chamber of the case body of the toy gun and target set of FIG. 1 showing toy guns received on the inside.

The play of the toy gun and target set is outlined herein after with reference to the annexed drawings. The case 01 is opened, then the curtain 02 and the folding back 03 are respectively extended out, and then the toy guns 15 are taken out of the bottom chamber 0131. The mobile target 12 is then inserted in the plug hole 04111 on either flange 0411 of the conveyer belt 041 of either target conveyer 04. Then, the sliding rack 051 is pulled out of the case body 013 to wind tight the clockwork & get set 05, and therefore the belt pulley 06 and the driven wheel 07 are turned to move the target conveyers 04 in carrying the target 12. At the same time, a link 14 is moved from the neck portion 0512 of the sliding rack 051 to the body portion 0511 thereof (see FIGS. 1, and 5-2) to compress a return spring 132, causing a connecting rod 131 turned downwards, and therefore the GAME OVER sign 13 which is fastened to the connecting rod 131 is turned downwards from a vertical position to a horizontal position and received within the case body 013. The bullets which did not hit the mobile target 12 are stopped by the curtain 02 and the folding back 03 and then guided to the bullet collecting drawer 11 through the concave top surface 09 and guide slot 10 of the case body 013. As the clockwork power of the clockwork & gear set 05 was completely released, the sliding rack 051 is returned back to its former position, and the return spring 132 moves the link 14 from the body portion 0511 of the sliding rack 051 to the neck portion 0512 thereof, and therefore the connecting rod 131 and the GAME OVER sign 13 are lifted from the horizontal position to the vertical position (see FIG. 5-1). After the game, the bullets which are retained in the spaces 122 between the pins 121 can be removed from the mobile target 12 by turning the face boards 123 outwards from the mobile target 12 respectively.

What is claimed is:

1. A toy gun and target set, comprising:

a carrying case formed of a case body and a cover hinged to said case body, said cover comprising a pleated, expansible back board and a curtain hung on the inside in front of said back board, said case body comprising a bottom chamber, which receives at least one toy gun, a toy bullet collecting drawer, a guide slot connected to said toy bullet collecting drawer, a concave top surface for guiding toy bullets to said toy bullet collecting drawer through said guide slot;

a driving mechanism installed inside said case body and comprised of a sliding rack and a clockwork and gear set meshed with said sliding rack, said clockwork and gear set being turned to work as said sliding rack is pulled out of said case body, said sliding rack having a series of parallel teeth on a body portion thereof meshed with said clockwork and gear set and a neck portion on one end of said body portion;

two target conveyers mounted within said case body and driven to rotate by said clockwork and gear set at different speeds, each target conveyer comprising two wheels and a conveyer belt mounted around the wheels, said conveyer belt having a series of flanges around the outside surface, each flange having a plug hole;

a mobile target mounted on the plug hole on either flange of the conveyer belt of either target conveyer, said mobile target having pins longitudinally and transversely aligned on two opposite sides of a target body thereof and respectively inserted through pin holes on two opposite face boards thereof, said face boards being respectively hinged to said target body and turned outwards from said target body to remove toy bullets being retained in spaces between said pins; and a game over sign and a linking mechanism connected to said sliding rack, said linking mechanism being moved from said neck portion of said sliding rack to said body portion of said sliding rack to turn said game over sign from a vertical position to a horizontal position as said sliding rack is pulled out of said case body, said linking mechanism being moved from said body portion of said sliding rack to said neck portion of said sliding rack to turn said game over sign from said horizontal position to said vertical position as said sliding rack is moved back into said case body by said clockwork and gear set.

* * * * *